United States Patent [19]

Schlegel

[11] 4,050,275

[45] Sept. 27, 1977

[54] METHOD AND APPARATUS FOR ALIGNING A VALVE HEAD

[75] Inventor: Fred Schlegel, Ceresco, Mich.

[73] Assignee: Eaton Corporation, Cleveland, Ohio

[21] Appl. No.: 632,125

[22] Filed: Nov. 14, 1975

[51] Int. Cl.[2] ..... B21B 1/20; B21B 1/42

[52] U.S. Cl. ..... 72/92; 29/156.7 R

[58] Field of Search ..... 29/156.7 R, 156.7 B; 72/92, 91, 93, 94

[56] References Cited

U.S. PATENT DOCUMENTS

| | | | |
|---|---|---|---|
| 1,755,663 | 4/1930 | Poetzinger | 29/156.7 R |
| 3,930,392 | 1/1976 | Matej | 72/92 |

*Primary Examiner*—C.W. Lanham
*Assistant Examiner*—Daniel C. Crane
*Attorney, Agent, or Firm*—Teagno & Toddy

[57] ABSTRACT

A method and apparatus for aligning the head of an engine valve in relation to the valve stem. A pair of die members is provided, the first die member being fixed relative to the frame of the apparatus and the second die member being cylindrical and rotatably mounted relative to the first die member. Each of the die members includes a surface for engaging the stem of the valve to straighten the valve stem as it is rolled between the surfaces in a generally arcuate path. A head straightening assembly is disposed adjacent the die members, including a straightening wheel freely rotatable relative to the die members. The straightening wheel includes a straightening surface which rollingly engages the surface of the valve head as the valve stem is rolled between the die surfaces in the arcuate path. The straightening surface is permitted to move at a surface speed approximately the same as the surface speed of the valve head, thus eliminating rubbing action between the valve head and the straightening surface, as well as any substantial torsional force on the valve stem.

13 Claims, 3 Drawing Figures

METHOD AND APPARATUS FOR ALIGNING A VALVE HEAD

BACKGROUND OF THE DISCLOSURE

The present invention relates to the manufacture of valves for internal combustion engines, and more particularly, to the alignment of the valve head relative to the valve stem.

Poppet valves for internal combustion engines are conventionally made by forging, after which the valve head must be aligned relative to the valve stem to facilitate finish machining operations.

In the prior art it has been common practice to align the valve head relative to the valve stem by rolling the valve stem between a pair of flat dies, usually with one being stationary and the other reciprocating back and forth relative to the stationary die. With this arrangement, the alignment of the valve head was accomplished by positioning a straight head straightening bar on the stationary die, thus engaging the surface of the valve head and aligning it relative to the stem during rolling of the stem. Although this provided a generally satisfactory alignment between the valve head and the stem the use of a reciprocating die meant that only one valve could be processed at a time. In addition, because of the difference in the diameters of the valve stem and valve head, the surface speed of the valve head is much greater than that of the stem, resulting in a skidding or rubbing action between the surface of the valve head and the stationary head straightening bar. Such a rubbing action resulted in wear of the surface of the straightening bar and/or of the valve head, and at the same time, the frictional force between the rubbing surfaces imparted a torsional force to the valve head, relative to the valve stem.

A more recent development in the prior art has been the use of a piece of equipment such as a rotary die thread roller where the thread dies have been replaced by a set of dies including a stationary die having an arcuate die surface and a cylindrical, rotating die having an external die surface, with the valve stem being rolled between the external surface of the rotating die and the arcuate surface of the stationary die. As in the previous description of the prior art, this apparatus utilizes a head straightening bar positioned on the stationary die. The use of such a rotary die increases the rate of production, as the die rotates continuously in one direction and additional valves may be positioned between the die surfaces while the previous valve is still being rolled. However, there still remains the problem of the rubbing action between the surface of the valve head and the surface of the straightening bar.

SUMMARY OF THE INVENTION

Accordingly, it is an object of the present invention to provide a method and apparatus for aligning the head of a valve relative to the valve stem which substantially eliminates torsional forces being applied to the valve head while the valve stem is being rolled between the stem straightening dies.

It is a more specific object of the present invention to provide such method and apparatus for aligning the head of a valve which substantially eliminates skidding or rubbing between the mating surfaces of the valve head and the head straightening means.

It is an even more specific object of the present invention to provide an apparatus for aligning the valve head, relative to the valve stem, by means of a straightening wheel having a surface engaging the surface of the valve head, the straightening wheel being free to rotate at the same surface speed as the valve head while the valve stem is being rolled between the stationary die and the rotating die.

The above the other objects of the present invention are accomplished by the provision of an improved method for aligning a valve head relative to a valve stem. The method comprises rotating the valve stem and straightening the stem while it is rotating. At the same time, the valve is transported in a direction generally perpendicular to its longitudinal axis such that the axis defines a generally arcuate path. A straightening wheel is provided having a generally arcuate straightening surface oriented to engage the valve head and define a line of contact therebetween. While the valve is moving in the generally arcuate path the straightening surface is moved relative to the valve head to cause the straightening surface to engage the valve head. The straightening surface is permitted to move at a surface speed approximately the same as the surface of the valve head, thereby eliminating rubbing action therebetween.

The above and other objects of the present invention are also accomplished by the provision of an apparatus which comprises a first frame, a first die member fixed to the first frame and a second die member mounted to be rotatable relative to the first die member. Each of the first and second die members include a surface for engaging the stem, the surfaces defining a gap therebetween for receiving the stem and cooperating to straighten the stem during rotation of the second die member. A straightening head assembly is disposed adjacent the die members, the assembly including the second frame and a straightening wheel rotatably supported by the second frame. The straightening wheel includes a surface disposed to rollingly engage the valve head as the stem is rolled between the die surfaces.

DESCRIPTION OF THE PREFERRED EMBODIMENT

Figure 1:
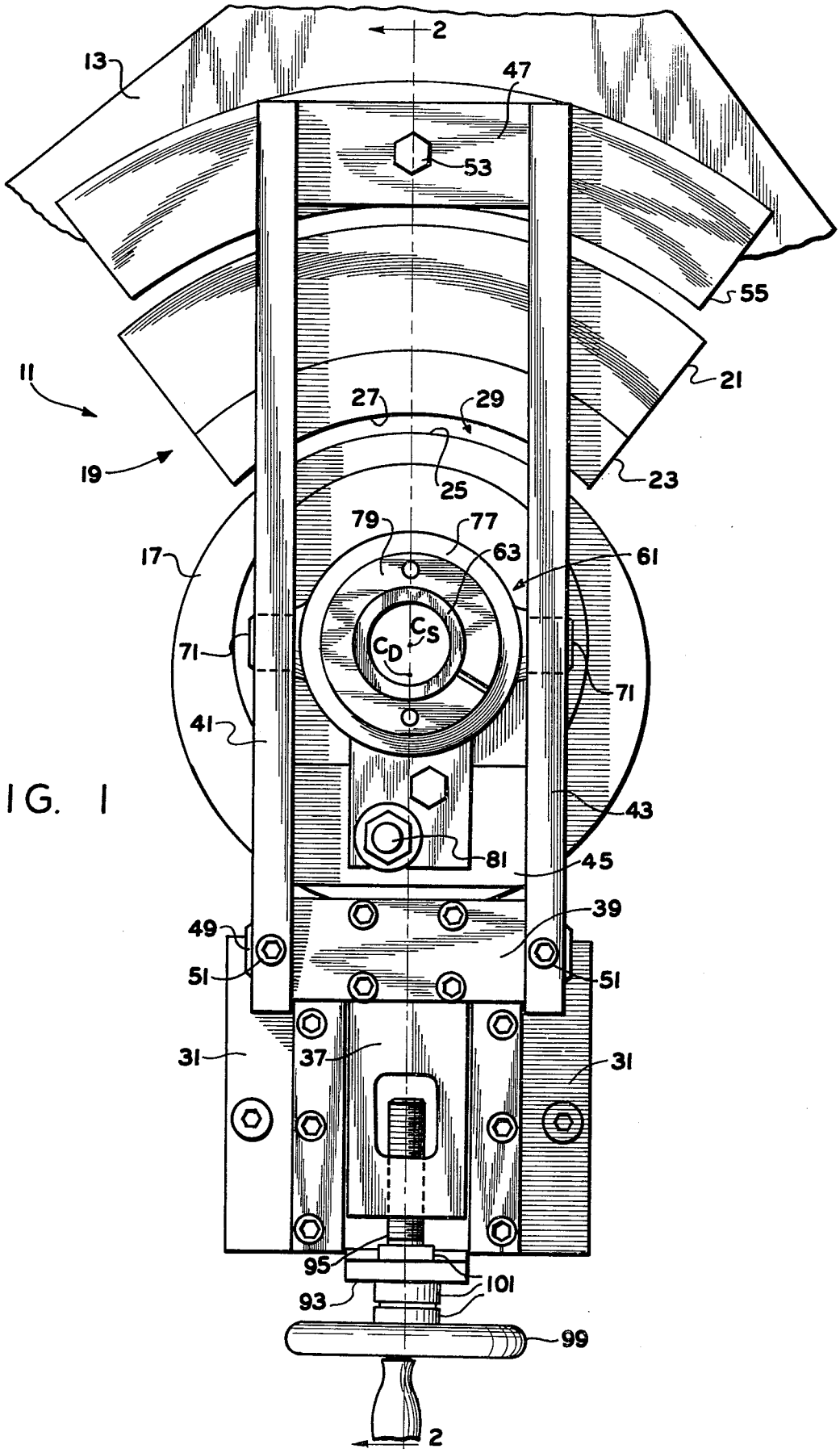
FIG. 1 is a plan view of the alignment apparatus of the present invention.
Figure 2:
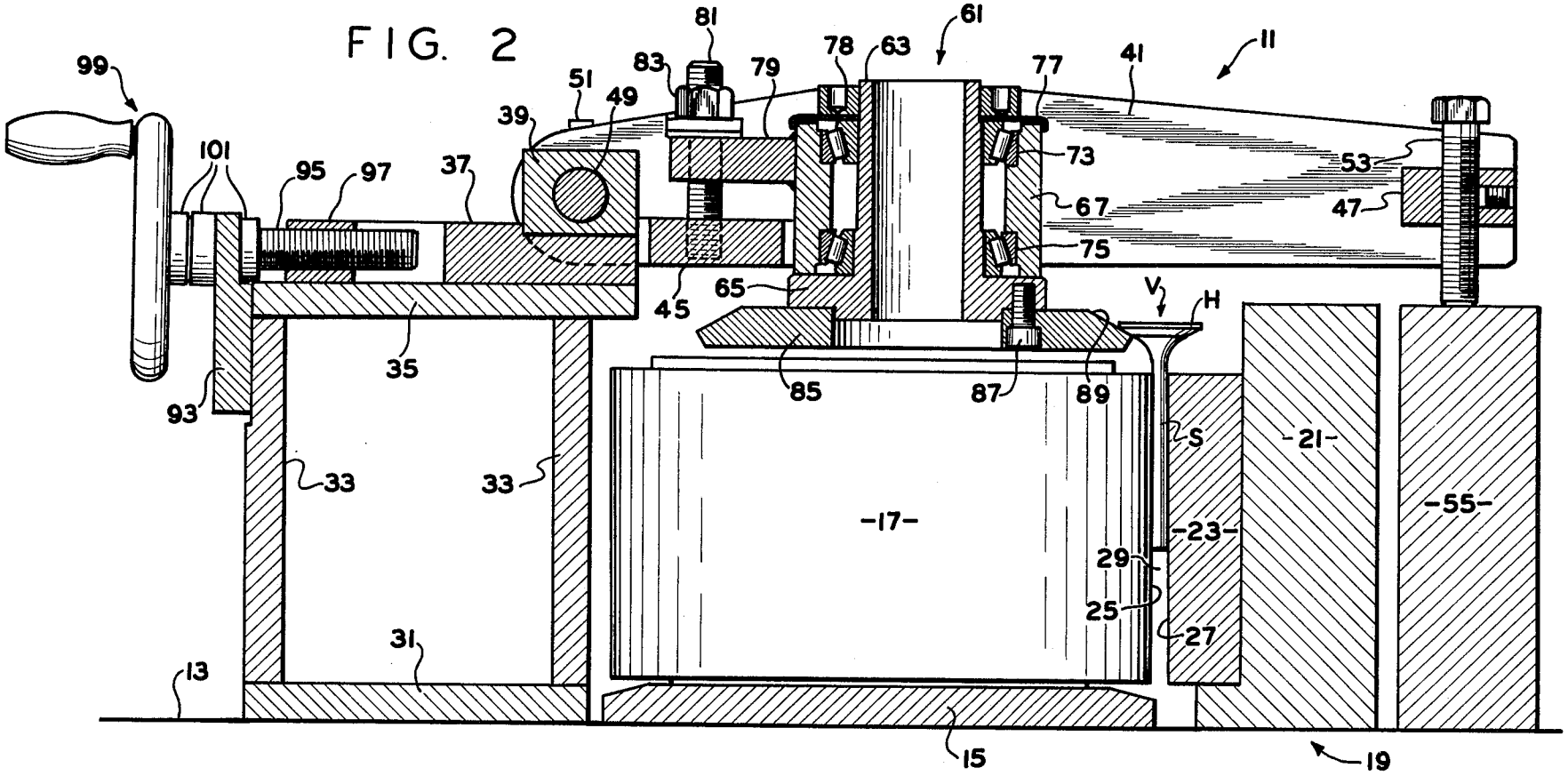
FIG. 2 is a cross-section taken on line 2—2 of FIG. 1, and on the same scale as FIG. 1.

Referring now to the drawings, which are not intended to limit the present invention, FIG. 1 is a plan view of the valve head aligning apparatus of the present invention, and FIG. 2 is a cross-section thereof. As was stated previously, it has been known in the prior art to straighten valve stems by means of a thread-rolling machine, such as is commercially available from Prutton Corporation, with the thread dies being replaced by straightening dies.

Thus, the aligning apparatus of the present invention, generally designated 11, is illustrated in position on an upper surface 13 of a typical thread-rolling machine. Projecting beyond the upper surface 13 is a die support portion 15 which is rotatably driven by the machine power source, and in turn, drives a rotary die 17. Adjacent the rotary die 17 is a stationary die assembly 19 including an arcuate die support 21 against which is seated an arcuate stationary die 23. The rotary die 17 defines an exterior die surface 25, while the arcuate stationary die 23 defines an arcuate, interior die surface 27, the die surfaces 25 and 27 cooperating to define a gap 29. As is now well known in the art, a valve V may have its stem S straightened by placing the stem S into the gap 29 as the rotary die 17 is turning, such that the stem S is rolled between the adjacent die surfaces 25 and 27.

Therefore, the present invention utilizes the previously-described apparatus and method for straightening the valve stem S, and in addition, provides the remainder of the aligning apparatus 11 shown in FIGS. 1 and 2 in order to align the valve head H, relative to the valve stem S, while the valve stem S is being rolled and straightened between die surfaces 25 and 27.

The aligning apparatus 11 includes a frame member 31 in engagement with the upper surface 13, adjacent die support portion 15, and extending upwardly from the frame member 31 is a pair of frame risers 33 (see FIG. 2). Across the tops of the frame risers 33 is a slide support member 35 (see FIG. 2). In sliding engagement with the upper surface of the slide support member 35 is a slide member 37, the function of which will be described in greater detail subsequently, but which has, mounted to its upper surface, a hinge block 39.

The hinge block 39 extends between a pair of beam members 41 and 43 which are rigidly held in the position shown by a spacer block 45, adjacent the hinge block 39, and a spacer block 47 toward the opposite end of the beams 41 and 43. Preferably, the beam members 41 and 43 are fixed to the ends of the spacer blocks 45 and 47 by removable means, such as cap screws, rather than being welded, to permit disassembly and maintenance of the apparatus.

Extending axially through the hinge block 39, and through the beam members 41 and 43, is a hinge pin 49 which is held in fixed relationship with the beam members 41 and 43 by means of a pair of socket head set screws 51. This arrangement permits the assembly of the beam members 41 and 43, spacer blocks 45 and 47 and hinge pin 49 to pivot about the axis of the hinge pin 49 relative to the hinge block 39 for reasons which will be apparent subsequently.

In threaded engagement with the spacer block 47 is a threaded member 53, the bottom of which is in engagement with the top surface of an arcuate support block 55, thus making it possible to adjust the angle of the beam assembly by merely turning threaded member 53.

Disposed between the beam members 41 and 43, and intermediate the spacer blocks 45 and 47 is a spindle assembly 61 including a spindle 63 which is generally cylindrical and terminates, at its lower end, in a radially-extending flange portion 65. The spindle assembly 61 further includes an annular spindle support 67, disposed in surrounding relation to the spindle 63, and including a pair of diametrally-opposed, cylindrical bearing portions 71 extending through holes in the beam members 41 and 43, and free to rotate therein such that the spindle assembly 61 is pivotable about the axis of the bearing portions 71.

Sealed between the spindle 63 and annular spindle support 67 are suitable bearing sets 73 and 75, permitting the spindle 63 to rotate smoothly and freely within the spindle support 67, even when a radial load is applied to the spindle 63. Disposed about the spindle 63 and in engagement with the upper portion of the spindle support 67 is a shield 77 which assists in maintaining the position of the cone of bearing set 73, and in turn, the shield 77 is held tightly in place by a lock nut 79.

Fixedly attached, such as by welding, to the outer surface of the annular spindle support 67 is a projecting frame portion 79 which extends out over spacer block 45.

Extending through the projecting frame portion 79, and free to rotate therein, is a stud member 81, the lower portion of which is in threaded engagement with spacer block 45. As the stud 81 is turned, such as by means of engaging a nut 83, the position of the spindle assembly 61 about the axis of the bearing portions 71 may be finely adjusted. A generally annular straightening wheel 85 is rigidly mounted on the underside of the flange 65, such as by means of a plurality of socket head cap screws 87. The straightening wheel 85 includes a frusto-conical straightening surface 89 which, with the aligning apparatus 11 in the operative position shown in FIG. 2, is disposed to engage the undersurface of valve head H. It should be apparent, in view of the configuration of the straightening surface 89 and the configuration of the valve head H, that there will be line contact therebetween.

Figure 3:
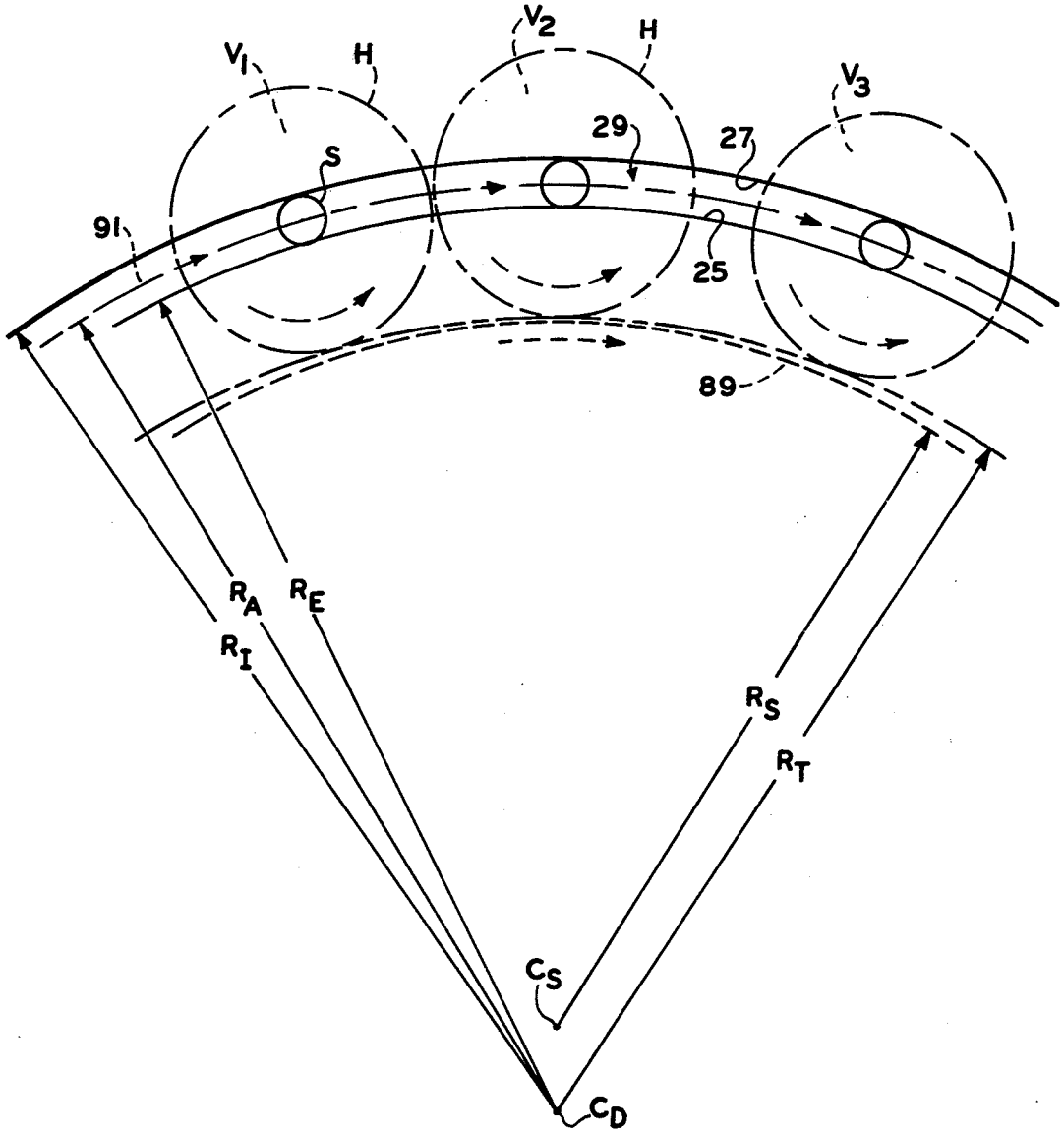
FIG. 3 is a somewhat diagrammatic representation of the method of the present invention illustrating various geometric relationships of the apparatus of the invention.

Referring now to FIG. 3, in conjunction with FIGS. 1 and 2, the method of aligning the valve head H relative to the valve stem S is represented schematically with three different valves $V_1$, $V_2$, and $V_3$ being shown. It should first be noted that FIG. 3 is illustrated on a scale approximately triple that of FIGS. 1 and 2 and that FIG. 3 contains a pair of center of curvature points (also in FIG. 2), $C_S$ being the center of curvature of the straightening wheel 85 which has a radius $R_S$. The other center shown is the center of curvature of the dies $C_D$. The internal die surface 27 has a radius $R_I$ while the external die surface 25 defines a radius $R_E$, and as the valve stem S of each valve is rolled between the die surfaces 25 and 27 by the rotation of rotary die 17, the longitudinal axis of the valve stem S defines an arcuate path 91 having a radius about center $C_D$ of $R_A$. It should further be noted that as the longitudinal axis of each valve moves along the arcuate path 91, the rotation of the valve head H defines a tangent circle having a radius $R_T$ about center $C_D$. Because the diameter of each valve head H is substantially larger than the diameter of the valve stem S, it will be apparent that the surface speed of the underside of the valve head H, in engagement with straightening surface 89, is substantially greater than the surface speed of the valve stem S and likewise of the external die surface 25.

To illustrate the method schematically, the straightening surface 89 is shown in dotted line form, having a radius $R_S$ about center $C_S$, and for purposes of clarity, the dotted line representing straightening surface 89 is displaced radially inward from the dotted line representing the tangent circle of the valve heads H. Assuming in FIG. 3 a clockwise rotation of the rotary die 17, is represented by the arrow adjacent external die surface 25, the longitudinal axis of each of the valves $V_1$, $V_2$, and $V_3$ moves in a clockwise direction along the arcuate path 91 as is shown by the arrowheads on arcuate path 91. As this occurs, the counterclockwise rotation of each of the valves $V_1$, $V_2$, and $V_3$ is shown by the dotted line arrows positioned within the valve heads H. Thus, the straightening wheel 85 and straightening surface 89 will rotate clockwise when in engagement with one of the valve heads H. Referring now to valve $V_1$, it will be noted that the tangent circle is separated by a greater distance from the line representing straightening surface 89 at a point adjacent the valve $V_1$ than at a point adjacent the valve $V_2$, thus indicating that the head H of valve $V_1$ is not in engagement with the straightening surface 89. The next valve $V_2$ has its head H in rolling engagement with the straightening surface 89, and it should be noted, that in order for the head H to make one full revolution, it is necessary for the valve stem S to move along the arcuate path 91 a distance equal only to the circumference of the valve stem S, such that in the embodiment shown, the head H of valve $V_2$ has at least about one full revolution in rolling engagement with the straightening surface 89. The next valve shown, $V_3$, has reached a point on the arcuate path 91 where its head H is no longer in rolling contact or engagement with the straightening surface 89, and with continued rotation of rotary die 17, the valve $V_3$ will travel only a short additional distance along arcuate path 91 before becoming disengaged from die surfaces 25 and 27.

Referring again to FIG. 2, there is shown a support member 93 attached to the forward surface of one of the frame risers 33, and extending above the slide support 35. Extending through the support member 93 is an adjustment screw 95 which is in threaded engagement with a forward portion 97 of the slide member 37 at the forward end of the adjustment screw 95 is a hand wheel 99, (not shown in FIG. 1), included to facilitate turning of the adjustment screw 95. Disposed about the adjustment screw 95, on either side of the support member 93, are a plurality of collar members 101 which prevent axial movement of the adjusting screw 95 relative to the support member 93. Thus, it will be seen that rotation of the hand wheel 99 causes the slide member 37 to move axially (to the left or right in FIG. 2) which, in turn, moves the entire beam assembly, the spindle assembly 61 and the straightening wheel 85 to provide a fine adjustment of the radial position of the straightening surface 89 with respect to the head H of the valve V. This adjustment feature of the present invention facilitates the use of the aligning apparatus 11 with different valves having different head sizes.

It should also be seen that the feature of the present invention whereby the beam assembly may be pivoted, relative to the framework about the hinge pin 49 permits access to the straightening wheel 85 and to the socket head cap screws 87 which attach the wheel 85 to the flange 65. This permits maintenance of various parts of the apparatus, especially the straightening wheel 85, which may easily be removed and replaced in case of damage.

I claim:

1. Apparatus for aligning the head of an engine valve in relation to the stem of the valve, said apparatus comprising:

a. a first frame;

b. a first die member fixed relative to said first frame;

c. a second die member mounted to be rotatable relative to said first die member and said first frame, each of said first and second die members including a die surface for engaging the stem, said die surfaces defining a gap for receiving the stem, said die surfaces cooperating to straighten the stem during rotation of said second die member;

d. a head straightening assembly adjacent said die members, said assembly including a second frame, and a straightening wheel freely rotatably supported by said second frame;

e. said straightening wheel including a surface disposed to rollingly engage the surface of the valve head as the stem is rolled between said die surfaces.

2. Apparatus as claimed in claim 1 wherein said second die member is generally cylindrical and rotates about its central axis.

3. Apparatus as claimed in claim 2 wherein said surface of said first die member defines a portion of a cylinder having a radius larger than the radius of said second die member by approximately the diameter of the valve stem.

4. Apparatus as claimed in claim 1 wherein said surface of said straightening wheel is generally frusto-conical and engages the surface of the valve head tangentially.

5. Apparatus as claimed in claim 4 wherein said surface of said straightening wheel has an average radius which is less than the radius of said second die member.

6. Apparatus as claimed in claim 1 wherein said straightening wheel is movable on a plane perpendicular to the central axis of said second die member to provide radial adjustment of said straightening wheel relative to the surface of the valve head.

7. Apparatus as claimed in claim 1 wherein said second frame includes a first frame portion fixed relative to said first frame and a second frame portion hingedly mounted relative to said fixed first frame portion, said straightening wheel being carried by said second frame portion.

8. Apparatus for aligning the head of an engine valve relative to the valve stem, said apparatus comprising:

a. support means;

b. drum means rotatably mounted on said support means including straightening means adapted to contact the valve stem;

c. presser means mounted on said support means, said presser means being operable to urge the valve stem into driving contact with said drum means and to straighten said stem during rotation of said drum means;

d. straightening means freely rotatable with respect to said support means, said straightening means including cam means adapted to contact the head of the valve during rotation thereof; and, e. means operable to urge said cam means into rotary driving contact with said valve head and operable to align the valve head normal with respect to its stem during rotation thereof.

9. A method of aligning the head of an engine poppet valve relative to the stem of the valve, comprising:

a. rotating the valve about its longitudinal axis;

b. straightening the stem of the valve while the valve is rotating;

c. simultaneously with steps (a) and (b), transporting the valve in a direction generally perpendicular to its longitudinal axis such that the longitudinal axis of the valve defines a generally arcuate path;

d. providing a generally arcuate freely moving straightening surface oriented to engage the valve head and define a line of contact therebetween;

e. during a portion of step (c), moving said straightening surface relative to the valve head to cause said straightening surface to engage the valve head; and f. permitting said straightening surface to move at a surface speed approximately the same as the surface speed of the valve head.

10. A method as claimed in claim 9 including the step, subsequent to step (e), of rotating the valve head at least about one-half revolution.

11. A method as claimed in claim 9 wherein the radius of said arcuate straightening surface is less than the radius of said generally arcuate path.

12. A method as claimed in claim 9 wherein said rotating and said transporting of the valve define a circle tangent to the valve head, said circle having a radius approximately equal to the radius of said arcuate straightening surface.

13. A method of aligning the head of an engine poppet valve relative to the stem of the valve, comprising:

a. rolling the valve stem along a rigid surface;

b. pressing the valve stem against the rigid surface while rolling to straighten the stem;

c. providing a freely moving rotary member having an aligning surface thereon adapted for contacting the head portion of the valve; and d. pressing said aligning surface of said rotary member into rolling contact with the head of said valve while the stem of the valve is rolling along said rigid surface.

* * * * *

UNITED STATES PATENT AND TRADEMARK OFFICE

CERTIFICATE OF CORRECTION

PATENT NO. : 4,050,275

DATED : September 27, 1977

INVENTOR(S) : Fred Schlegel

It is certified that error appears in the above-identified patent and that said Letters Patent are hereby corrected as shown below:

Col. 2, line 7: After "above" "the" should read "and".

Col. 3, line 19: After "adjacent" insert "the".

line 63: "Sealed" should read "Seated".

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*